US005558216A

United States Patent [19]

Focke et al.

[11] Patent Number: 5,558,216

[45] Date of Patent: Sep. 24, 1996

[54] HINGE-LID PACK FOR STICK-SHAPED ARTICLES, SUCH AS CIGARETTES, AND PROCESS FOR PRODUCING IT

[75] Inventors: Heinz Focke; Harald Gosebruch, both of Verden, Germany

[73] Assignee: Focke & Co. (GmbH & Co.), Verden, Germany

[21] Appl. No.: 207,175

[22] Filed: Mar. 8, 1994

[30] Foreign Application Priority Data

Mar. 9, 1993 [DE] Germany ..... 43 07 386.7

[51] Int. Cl.[6] ..... B65D 85/10; B65D 85/12

[52] U.S. Cl. ..... 206/256; 206/273

[58] Field of Search ..... 206/256, 257, 206/258, 273

[56] References Cited

U.S. PATENT DOCUMENTS

| | | | |
|---|---|---|---|
| 163,297 | 5/1875 | Brown | 206/256 |
| 163,313 | 5/1875 | Heyl | 206/256 |
| 3,159,272 | 2/1962 | Swift . | |
| 4,160,502 | 7/1979 | Roccaforte . | |
| 4,793,478 | 12/1988 | Tudor . | |
| 4,815,592 | 3/1989 | Kunkel . | |
| 5,433,318 | 7/1995 | Focke | 206/256 |

FOREIGN PATENT DOCUMENTS

| | | | |
|---|---|---|---|
| 443365 | 8/1991 | European Pat. Off. . | |
| 522225 | 1/1993 | European Pat. Off. . | |
| 1028686 | 2/1953 | France | 206/256 |
| 577933 | 5/1933 | Germany . | |
| 2525959 | 2/1977 | Germany . | |
| 8231810 | 5/1983 | Germany . | |
| 4005443 | 8/1991 | Germany . | |
| 201465 | 11/1938 | Switzerland . | |
| 103968 | 2/1917 | United Kingdom . | |
| 436630 | 10/1935 | United Kingdom | 206/258 |
| 455724 | 10/1936 | United Kingdom . | |
| 585258 | 2/1947 | United Kingdom . | |
| 588741 | 6/1947 | United Kingdom . | |
| 1068191 | 5/1967 | United Kingdom . | |

OTHER PUBLICATIONS

Soviet Patent Abstracts, Section PQ, Week 9435, Derwent Publications Ltd., London, GB; Class Q34, An 94–284251 & RU–C–2 009 088 (Volskii Yu N), Mar. 15, 1994.

*Primary Examiner*—B. Dayoan

*Attorney, Agent, or Firm*—Sughrue, Mion, Zinn, Macpeak & Seas

[57] ABSTRACT

Pack for stick-shaped articles, especially cigarettes. Hinge-lid packs are a customary form of packaging for cigarettes or similar articles (29). To arrange a plurality of articles (29) within the pack at a distance from one another, supporting walls (32, 33) are arranged at a distance from one another in a pack part (10) of the pack. The articles (29) pass through coaxially arranged recesses (35, 35) of the supporting walls (32, 33) and are thereby positioned in an exact relative position in relation to one another. The supporting walls (32, 33) are part of a supporting insert (42) which consists of a blank and which at the same time also forms a collar (38) arranged within the pack part (10).

1 Claim, 4 Drawing Sheets

Fig. 2
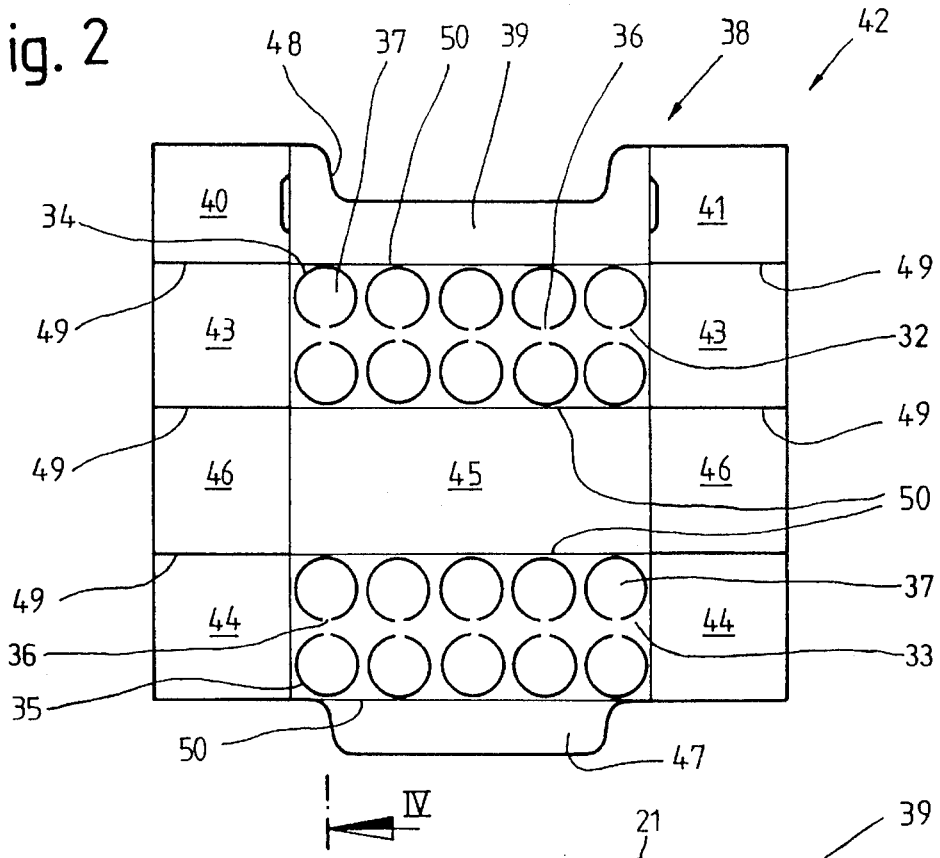
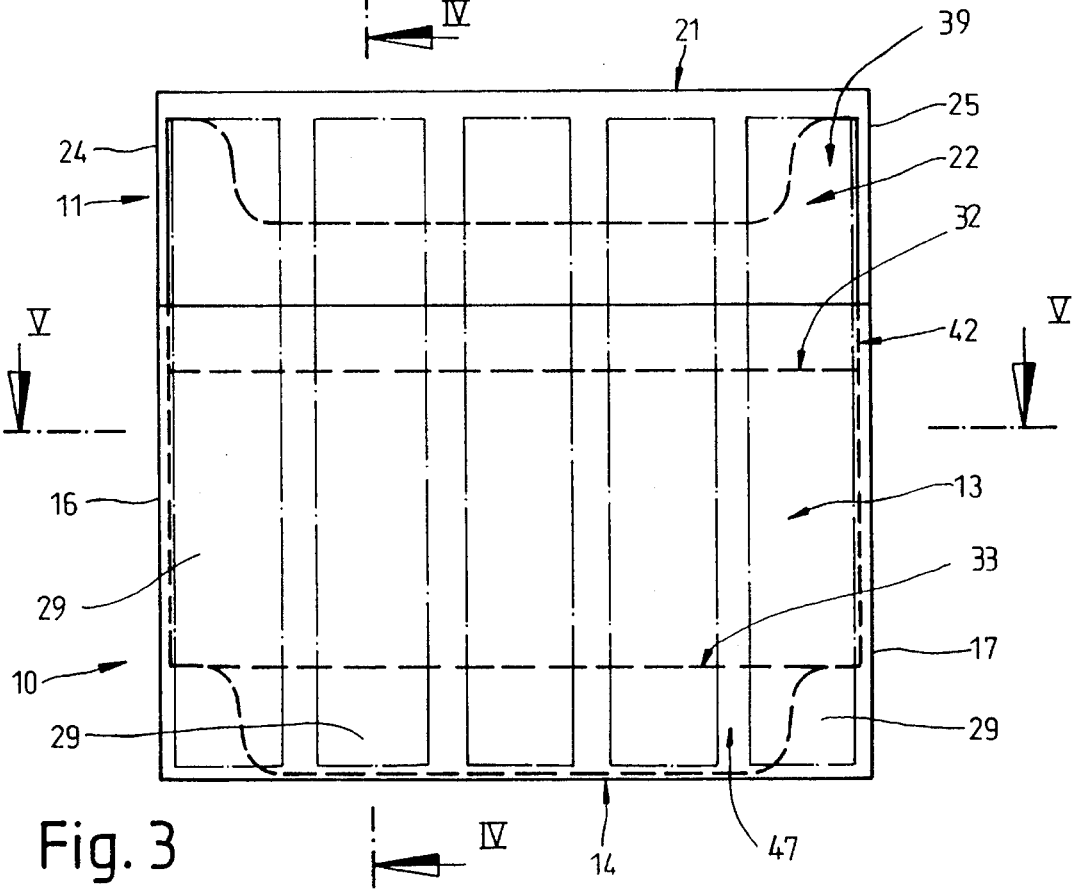
Fig. 3

HINGE-LID PACK FOR STICK-SHAPED ARTICLES, SUCH AS CIGARETTES, AND PROCESS FOR PRODUCING IT

BACKGROUND OF THE INVENTION

The invention relates to a hinge-lid pack for stick-shaped articles, such as cigarettes, with a pack part and a lid which is connected in an articulated manner to a rear wall of the pack part, and with a collar which consists of a collar front wall and collar side tabs and which is fixed in the pack part by means of a lower region. The invention relates, furthermore, to a process for producing a hinge-lid pack of this type.

Hinge-lid packs are a form of packaging for cigarettes and other elongate articles which is in use throughout the world. For the handling and/or for the protection of the cigarettes or other articles, it may be necessary to position the articles at a distance from one another within the hinge-lid pack, so that the cigarettes or the like do not lie against one another.

SUMMARY OF THE INVENTION

Proceeding from this, the object on which the invention is based is therefore to propose a hinge-lid pack for cigarettes or other elongate, especially cylindrical articles, in which the articles are positioned at a predetermined exact distance from one another and from the walls of the pack.

To achieve this object, the hinge-lid pack according to the invention is defined in that at least one transversely directed supporting wall is arranged within the pack part, with recesses for the passage of each of the articles, and in that the supporting wall is part of a blank for the collar and is connected to the collar front wall via a lower folding line.

In an advantageous embodiment of the pack, two transversely directed supporting walls with recesses for the passage of the articles are arranged within the pack part. This affords an especially stable positioning of the cigarettes or the like. The recesses in the supporting walls are arranged coaxially, preferably in two parallel rows.

According to the invention, the two supporting walls form, together with -the collar, a coherent supporting insert which consists of a one-piece blank. The supporting insert is designed and arranged in such a way that the collar assumes the positioning correct for hinge-lid packs, the supporting walls are arranged in a stable parallel position and the entire supporting insert is supported on the bottom of the hinge-lid pack.

In the process according to the invention for the production of such a pack, a group of articles corresponding to the pack contents is introduced into the recesses of the supporting insert and, together with the latter, is introduced as a unit into the fully or partially completed pack.

In the one-piece design of the supporting insert with collar and supporting leg, a further particular feature according to the invention is to be found in the sequence of the folding steps of the supporting insert.

An exemplary embodiment of the pack according to the invention and the folding steps for the supporting insert are explained in more detail below by means of the drawings. In these:

BRIEF DESCRIPTION OF THE DRAWINGS

FIG. 2 shows a spread-out blank for a supporting insert,

FIG. 3 shows a front view of a completed closed pack,

DETAILED DESCRIPTION OF PREFERRED EMBODIMENTS

Figure 1:
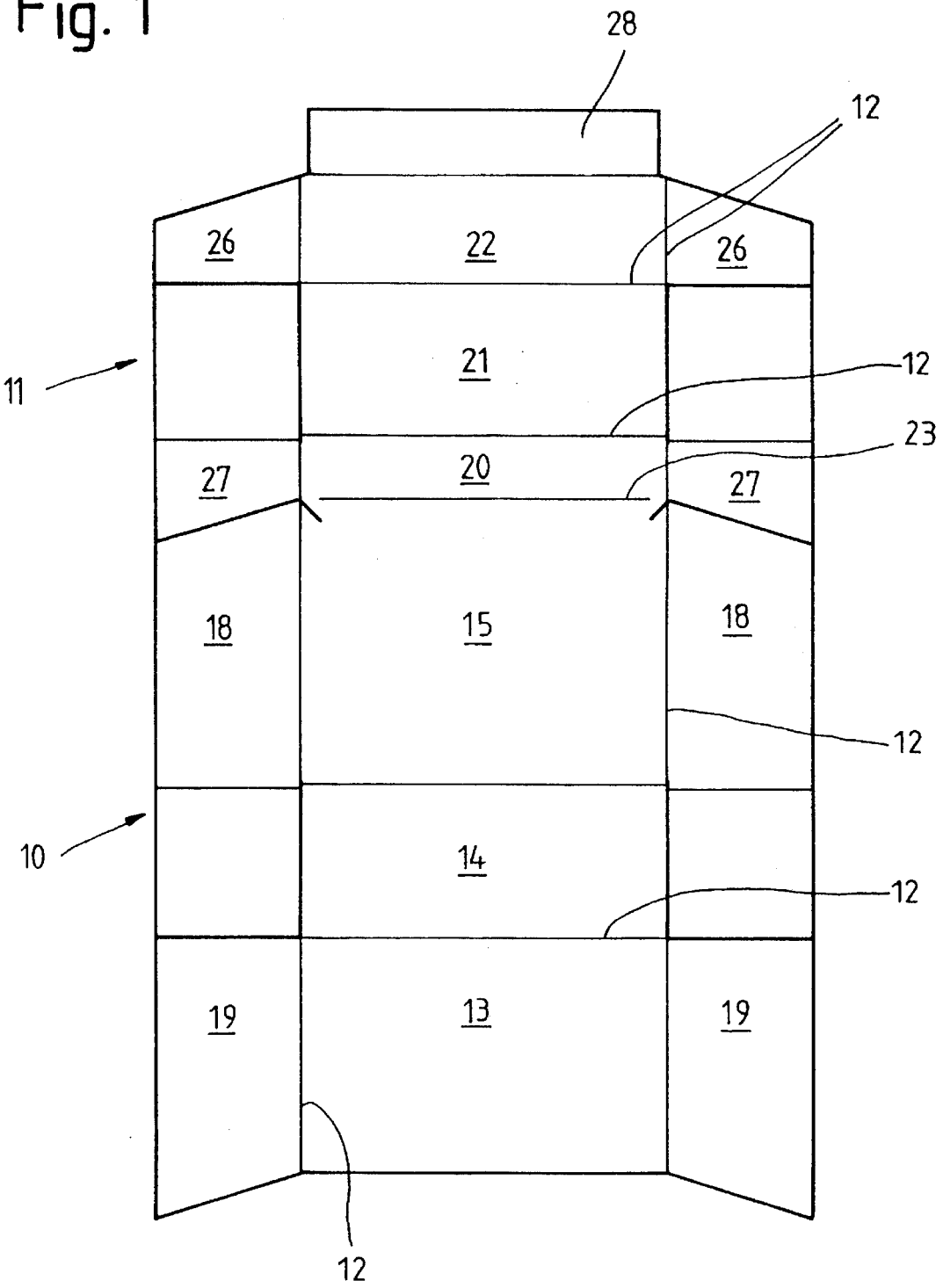
FIG. 1 shows a spread-out blank for a hinge-lid pack.

The novel internal design of a hinge-lid pack is shown as a preferred exemplary embodiment in the drawings. This hinge-lid pack consists of a pack part 10 and of a lid 11. FIG. 1 shows a conventional blank for such a hinge-lid pack. Folding lines 12 delimit regions for forming a front wall 13, a bottom wall 14 and a rear wall 15. Side walls 16 and 17 of the hinge-lid pack each consist of two side tabs 18 and 19 which overlap one another and which are connected to one another by adhesive bonding. The side tabs 18 adjoining the rear wall 15 are located on the inside.

Figure 4:
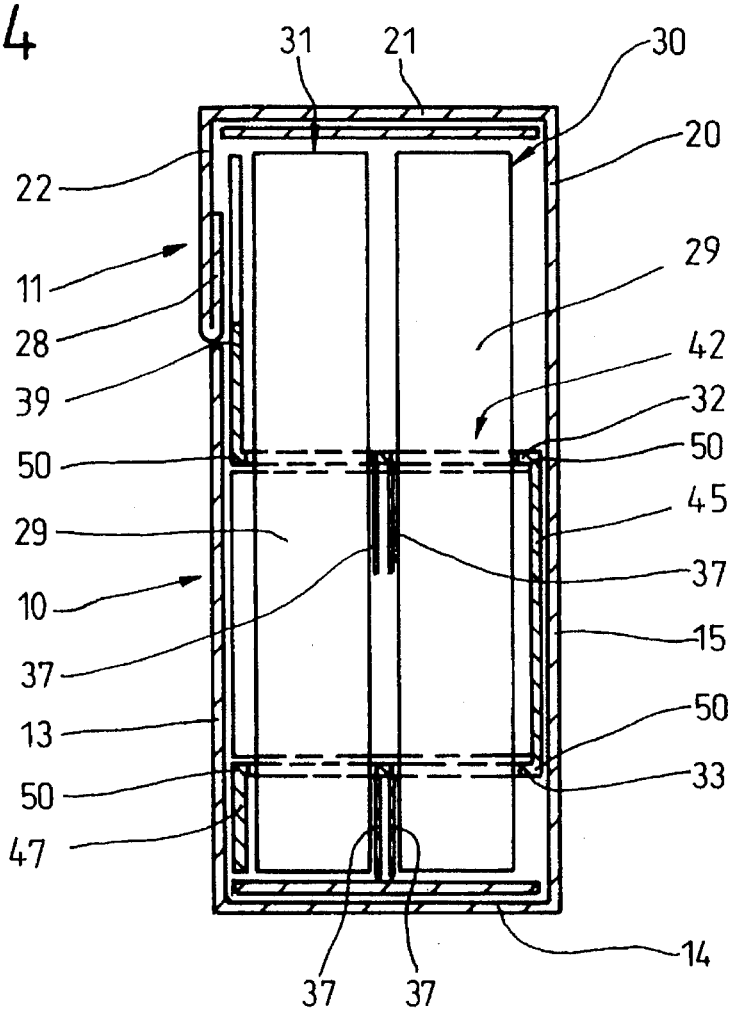
FIG. 4 shows a vertical section through the pack according to FIG. 3 in a sectional plane IV—IV.
Figure 5:
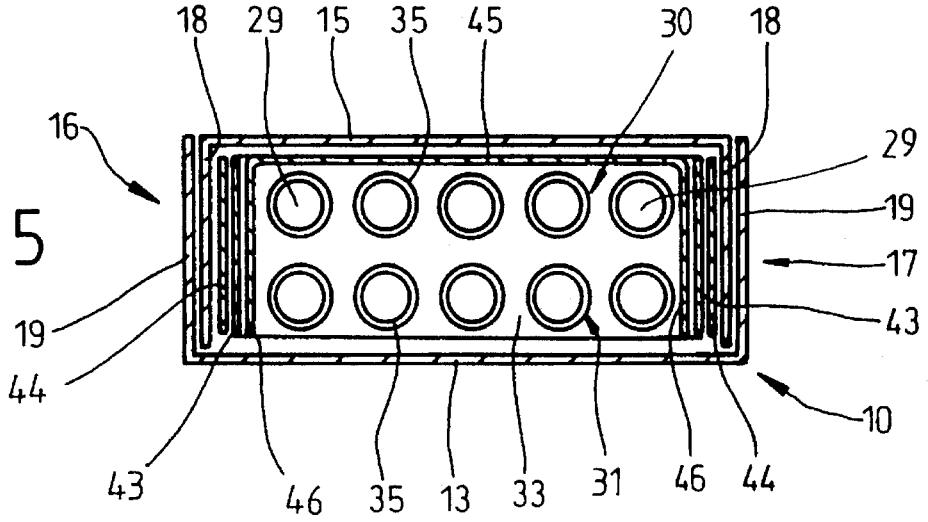
FIG. 5 shows a horizontal section through the pack according to FIG. 3 in the sectional plane V—V.
Figure 6:
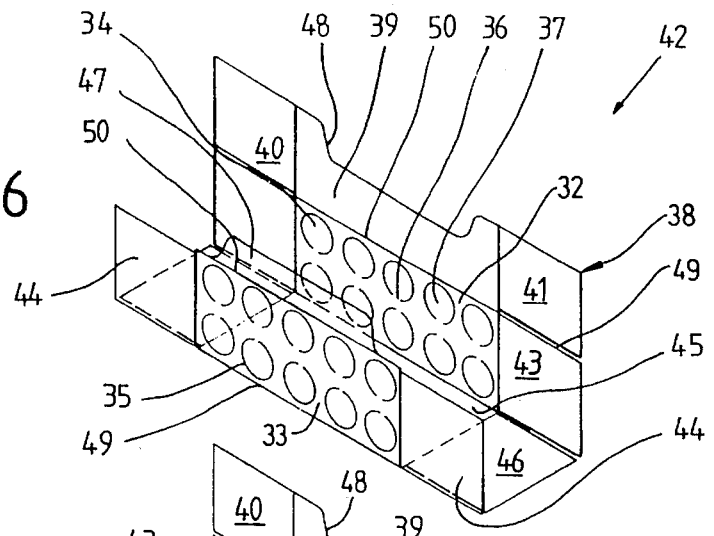
FIGS. 6–9 show successive folding steps for producing the supporting insert.

The lid 11 is designed in a similar way, with a lid rear wall 20, a lid top wall 21 and a lid front wall 22 which adjoin the rear wall 15 of the pack part in this order. Between the lid rear wall 20 and rear wall 15 is formed an articulation line 23 for the pivoting movements of the lid 11 during opening and closing. Lid side walls 24, 25 consist of lid side tabs 26 and 27 in a similar way to the design of the side walls 16, 17. An inner tab 28 is attached to the free edge of the lid front wall 22 and, in the finished pack, bears against the inside of the lid front wall 22 (FIG. 4).

The hinge-lid pack serves for receiving a group of elongate stick-shaped articles 29. These can be conventional cigarettes, but also other cigarette-like products. In the present exemplary embodiment, the pack is dimensioned in such a way that ten articles 29 are positioned in a vertical attitude in two rows 30, 31 within the hinge-lid pack. The articles 29 are arranged at distances from one another. Identical distances are provided within a row 30, 31. The distances from row to row can have other dimensions.

To maintain the relative position of the articles 29, each article 29 is supported and held at a distance. In the present exemplary embodiment, two supporting walls 32, 33 are arranged within the pack part 10. The supporting walls 32, 33 are arranged, in the longitudinal direction of the articles 29, at a distance from one another and also at a distance from the bottom wall 14 and from the lid 11. The supporting walls 32, 33 extend parallel to the bottom wall 14.

Each supporting wall 32, 33 is provided with a number of recesses 34, 35 corresponding to the number of articles 29. These recesses are positioned according to the relative position of the articles 29, that is to say in rows 30, 31. The recesses 34, 35 of the two supporting walls 32, 33 are positioned coaxially, that is to say coincidentally one above the other, so that each article 29 passes through a recess 34, 35 of one supporting wall 32, 33 and of the other.

The recesses 34, 35 correspond in shape to the outer contour of the article 29. In the present case, with a cylindrical design of the articles 29, circular recesses 34, 35 are punched in the supporting walls 32, 33. In the present case, the punching is not completely circular. Instead, a residual web 36 of the material of the supporting walls 32, 33 is formed. As a result, punched parts 37 in the form of a circular area, which are freed during punching, remain connected to the supporting wall 32, 33 via the residual web 36. The advantage of this measure is that the punched parts 37 are not left behind in the packaging machine as undesirable blank parts which are difficult to control. On the contrary, these punched parts 37 are held in the pack, where they do not cause any disturbance. As is evident from FIG. 4, the punched parts 37 are pivoted to the side, in particular downwards, as a result of the pushing of the articles 29 into the recesses 34, 35. The punched parts 37 extend, here, between the rows 30, 31 of the articles 29 outside the region of these and underneath the supporting walls 32, 33. The recesses 34, 35 have a slightly larger diameter than the outside diameter of the articles 29.

In the present exemplary embodiment, the supporting walls 32, 33 are connected to one another to form a one-piece blank (FIG. 2). Furthermore, a collar 38 is formed by the same blank. A collar of this type, as an insert in the pack part 10, is customary in hinge-lid packs. The collar 38 consists of a collar front wall 39 and of collar side tabs 40, 41. The collar front wall 39 bears against the inside of the front wall 13 of the pack part. The collar side tabs 40, 41 extend on the inside in the region of the side walls 16, 17. A part-region of the collar 38 projects from the pack part 10 and, in the closed position, is surrounded by the lid 11 (FIG. 4).

The blank according to FIG. 2 is designed in a special way in order to form a supporting insert 42 within the pack part 10. The width of the blank for this supporting insert 42 corresponds to the necessary width of the collar 38. Folding tabs 43 and 44 are thereby obtained in the region of the supporting walls 32, 33 on both sides of the latter. The distance between the supporting walls 32, 33 is determined by an intermediate piece 45 of the supporting insert 42, likewise with lateral folding tabs 46.

In the present exemplary embodiment, furthermore, a spacer tab 47 is formed in the middle region on the side located opposite the collar 38 and adjoins the free side of the lower supporting wall 33. The contour of this spacer tab 47 corresponds to the contour of a conventional recess 48 formed in the region of the collar front wall 39. By means of this overall contour, it is possible to produce the blank for the supporting insert 42 without waste by punching from a continuous material web consisting of thin cardboard or the like.

The collar side tabs 40, 41 and the folding tabs 43, 46 and 44 are divided off from one another by means of punching cuts 49.

The supporting insert 42 is shaped three-dimensionally in such a way that the collar 38, as a vertical leg, faces the front wall 13. The upper supporting wall 32 adjoins this by transverse folding. This is then followed, as a vertical folding part, by the rectangular intermediate piece 45 which bears against the rear wall 15 of the pack part 10. The lower supporting wall 33 adjoins the lower edge of the intermediate piece 45 by transverse folding. The downwardly folded spacer tab 47 is located on the side opposite the intermediate piece 45. The dimensions of the supporting insert 42 can be selected so that the spacer tab 47 stands up at the bottom on the bottom wall 14. Parts of the supporting insert 42, especially the collar 38 and/or intermediate piece 45, can be connected by adhesive bonding to the parts of the pack which face them. The regions of the supporting insert 42 are delimited from one another by means of parallel folding lines 50.

In the production of the pack so designed, first the supporting insert 42 is folded at least until the supporting walls 32, 33 assume the position appropriate for the pack. The group of articles 29, with relative distances being maintained, can then be fed as a unit to the supporting insert 42 and combined with the latter. The articles 29 pass, at the same time, through the previously formed recesses 34, 35, specifically with the punched parts 37 being pivoted. The unit thus formed is then introduced into the actual hinge-lid pack which is at least partially completed during this phase.

The sequence of folding steps for a supporting insert 42 according to FIG. 2 is shown in perspective in FIGS. 6 to 9.

According to these, first a U-shaped folding position of the blank is formed (FIG. 6), the fold being made in the region of the folding lines 50 delimiting the intermediate piece 45. The intermediate piece 45, together with the adjoining folding tabs 46, constitutes the web of this U-profile.

Figure 7:
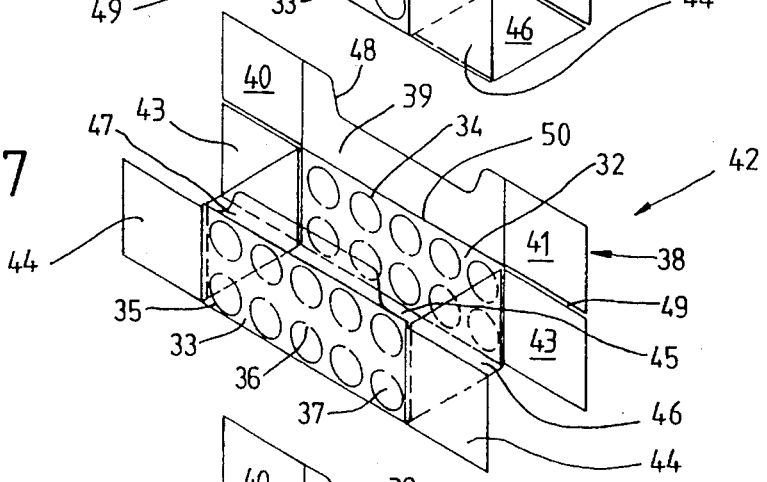
Figure 8:
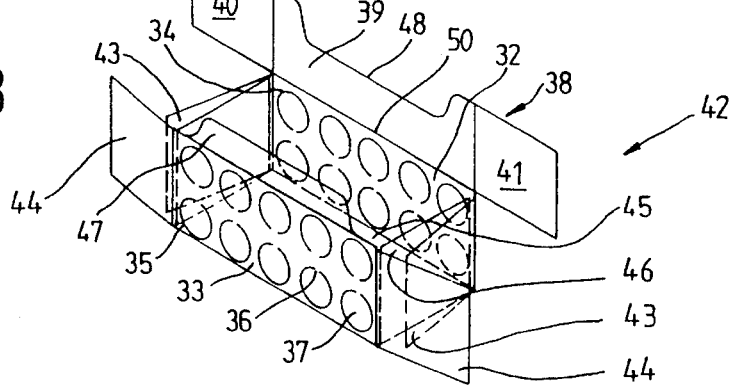
Figure 9:
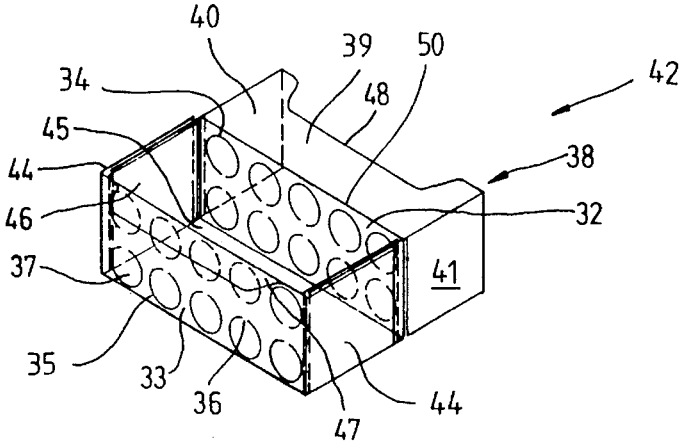

The folding tabs 46 are thereafter folded into a position transverse to the intermediate piece 45 (FIG. 7). In the next folding step according to FIG. 8, the folding tabs 43 of one upper supporting wall 32 are folded round, until they bear against the already folded folding tabs 46. The folding tabs 44 are then laid in the same way against the folding tabs 43 (FIG. 8). In the concluding folding steps, the collar 38 is folded into a position transverse to the supporting wall 32 and the collar side tabs 40 are then folded into a position transverse to the collar front wall 39. Furthermore, the spacer tab 47 is brought into a position transverse to the lower supporting wall 33. The supporting insert 42 is thus completed as a stable three-dimensional structure (FIG. 9). As a result of the multi-layered arrangement in part-regions (folding tabs 43, 44, 46), the supporting insert 42 constitutes a stabilizing member for strengthening the shape of the cuboid hinge-lid pack.

After the folding position according to FIG. 9 has been reached, the group of articles 29 can be pushed in the corresponding relative position through the supporting walls 32, 33. The supporting insert 42 is dimensioned in such a way that, in this folding position, the collar 38 assumes within the pack part the position appropriate for the pack (FIG. 4). The hinge-lid pack and supporting insert advantageously consist of thin cardboard or of an equivalent material.

What is claimed is:

1. A hinge lid pack for stick-shaped articles, wherein:

a) in a region of a pack rear wall (15), a lid (11) bears against a pack part (10) which has a pack front wall (13), the pack rear wall (15), a pack bottom wall (14) and pack side walls (16, 17);

b) corresponding to the pack part (10), the lid (11) has a lid front wall (22), lid rear wall (20), lid top wall (21), and lid side walls (24, 25);

c) in an upper region of the pack part (10) is arranged a collar (38) which is provided with at least one collar from wall (39) having a lower edge and collar side tabs (40, 41);

d) the collar (38) is fixed in the pack part (10) at least by regions of the collar front wall (39) which bear against the pack front wall (13);

(e) at a lower edge which forms a folding line (50), the collar front wall (39) is adjoined by a first supporting wall (32) which is angled relative to said collar front wall;

(f) the first supporting wall (32) is provided with a plurality of first recesses (34) arranged at a distance from one another, each for passage of one of said articles (29), and at a distance from the pack bottom wall (14);

(g) the collar (38) and the first supporting wall (32) are made from a common blank which, by three-dimensional folding, forms a supporting insert (42) for the pack part (10);

(h) wherein, at a distance from the first supporting wall (32) and also from the pack bottom wall (14), there is a second supporting wall (33) which is angled with respect to the pack front wall (13) or the pack rear wall (15), and which has second recesses (35) each for passage of one article, and wherein the first and second recesses (34, 35) are arranged in alignment relative to one another, such that each article (29) is held by both supporting walls; and (i) wherein the supporting insert (42) has, in a lower region thereof adjoining one edge of said second supporting wall (33), a spacer tab (47) which bears against the pack front wall (13) or pack rear wall (15) and which reaches as far as the pack bottom wall (14) and has the contour of a recess (48) formed in a region of the collar front wall (39).

* * * * *